US010585389B2

(12) United States Patent
Uohashi

(10) Patent No.: US 10,585,389 B2
(45) Date of Patent: Mar. 10, 2020

(54) IMAGE FORMING APPARATUS

(71) Applicant: KYOCERA Document Solutions Inc., Osaka (JP)

(72) Inventor: Yuki Uohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/455,292

(22) Filed: Jun. 27, 2019

(65) Prior Publication Data

US 2020/0019113 A1 Jan. 16, 2020

(30) Foreign Application Priority Data

Jul. 11, 2018 (JP) ..... 2018-131393

(51) Int. Cl.
*G03G 21/16* (2006.01)
*G03G 15/00* (2006.01)

(52) U.S. Cl.
CPC ..... *G03G 21/1695* (2013.01); *B65H 2405/10* (2013.01); *G03G 15/6502* (2013.01)

(58) Field of Classification Search
CPC ..... G03G 15/6502; G03G 15/6511; G03G 21/1695; G03G 2215/00383
See application file for complete search history.

(56) References Cited

U.S. PATENT DOCUMENTS 4,535,982 A * 8/1985 Mochimaru ..... B65H 1/266 271/127

FOREIGN PATENT DOCUMENTS

JP H 02-178122 A 7/1990
JP 2009-40517 A 2/2009

* cited by examiner

*Primary Examiner* — Erika J Villaluna
(74) *Attorney, Agent, or Firm* — Stein IP, LLC

(57) ABSTRACT

An image forming apparatus 100 includes a cassette fitting portion 1 which is provided in the main body of the image forming apparatus 100 and a paper feed cassette 30 which includes a sheet storage portion S. In the cassette fitting portion 1, a lift plate 50 is provided which raises and lowers a sheet 18. In the cassette base 31 of the sheet storage portion S, an opening portion 31*a* is formed in a position opposite the lift plate 50. The lift plate 50 is arranged selectively either in a lowered position in which the lift plate 50 is arranged below the cassette base 31 or in a raised position in which the lift plate 50 is protruded above the cassette base 31 through the opening portion 31*a* so as to allow the sheet 18 to be fed.

8 Claims, 5 Drawing Sheets

IMAGE FORMING APPARATUS

INCORPORATION BY REFERENCE

This application is based upon and claims the benefit of priority from the corresponding Japanese Patent Application No. 2018-131393 filed on Jul. 11, 2018, the entire contents of which are incorporated herein by reference.

BACKGROUND

The present disclosure relates to an image forming apparatus and more particularly to an image forming apparatus which includes a sheet storage cassette that is removable with respect to a cassette fitting portion in the main body of the image forming apparatus.

In an image forming apparatus such as a copying machine or a printer, a paper feed cassette (sheet storage cassette) is used in order to feed paper such as cut paper. In the paper feed cassette, a large number of sheets before printing are previously stocked in a sheet storage portion. The sheets stacked within the paper feed cassette are separated and supplied one by one from the uppermost layer with a paper feed roller, a pickup roller and the like provided in the vicinity of the paper feed cassette.

Conventionally, in a paper feed cassette, a lift plate is provided in which sheets are placed on its upper surface and which raises and lowers a sheet stack. In the lift plate, an upstream end in the feed direction is supported to the inner side of the bottom surface of the paper feed cassette. The lift plate can be turned about the supporting point of the upstream end in the feed direction with an end portion on the downstream side in the feed direction serving as a turning end. In the paper feed cassette, a lift mechanism is also provided which raises and lowers the turning end of the lift plate. A drive force is transmitted to the lift mechanism through a main body gear provided in the main body of the image forming apparatus, an input gear provided in the cassette side surface portion of the paper feed cassette and the like.

Incidentally, the lift plate affects the accuracy of paper feed, and thus the accuracy of the position is required. However, in the conventional image forming apparatus, the lift plate is provided in the paper feed cassette. Hence, both the accuracy of the position of the lift plate with respect to the sheet storage portion of the paper feed cassette and the accuracy of the position of the sheet storage portion with respect to the main body of the image forming apparatus are required.

In the lift plate, the sheet stack is raised and lowered, and thus rigidity is required. In the conventional image forming apparatus, the lift plate is provided in the paper feed cassette, and thus for the paper feed cassette which supports the lift plate, rigidity is also required. Hence, the weight of the paper feed cassette is increased, and thus the operability thereof by a user is lowered.

SUMMARY

An image forming apparatus of the present disclosure includes: a cassette fitting portion which is provided in the main body of the apparatus and which includes a feed portion that feeds a sheet; and a sheet storage cassette which can be fitted to the cassette fitting portion along the sheet feed direction and which includes a sheet storage portion that stores the sheet, in the cassette fitting portion, a lift plate is provided which is arranged below an end portion of the sheet storage cassette fitted to the cassette fitting portion on a downstream side in the sheet feed direction and which raises and lowers the sheet, the sheet storage portion includes a cassette base in which the sheet is stacked on an upper surface and a side wall which is provided so as to stand from end portions of the cassette base on the downstream side, in the cassette base, an opening portion is formed in a position opposite the lift plate and in a state where the sheet storage cassette is fitted to the cassette fitting portion, the lift plate is arranged selectively either in a lowered position in which the lift plate is arranged below the cassette base and in which the sheet storage cassette is removable with respect to the cassette fitting portion or in a raised position in which the lift plate is protruded above the cassette base through the opening portion so as to allow the sheet to be fed with the feed portion.

Further features and advantages of the present disclosure will become more apparent from the description of an embodiment given below.

DETAILED DESCRIPTION

An embodiment of the present disclosure will be described below with reference to drawings.

Figure 1:
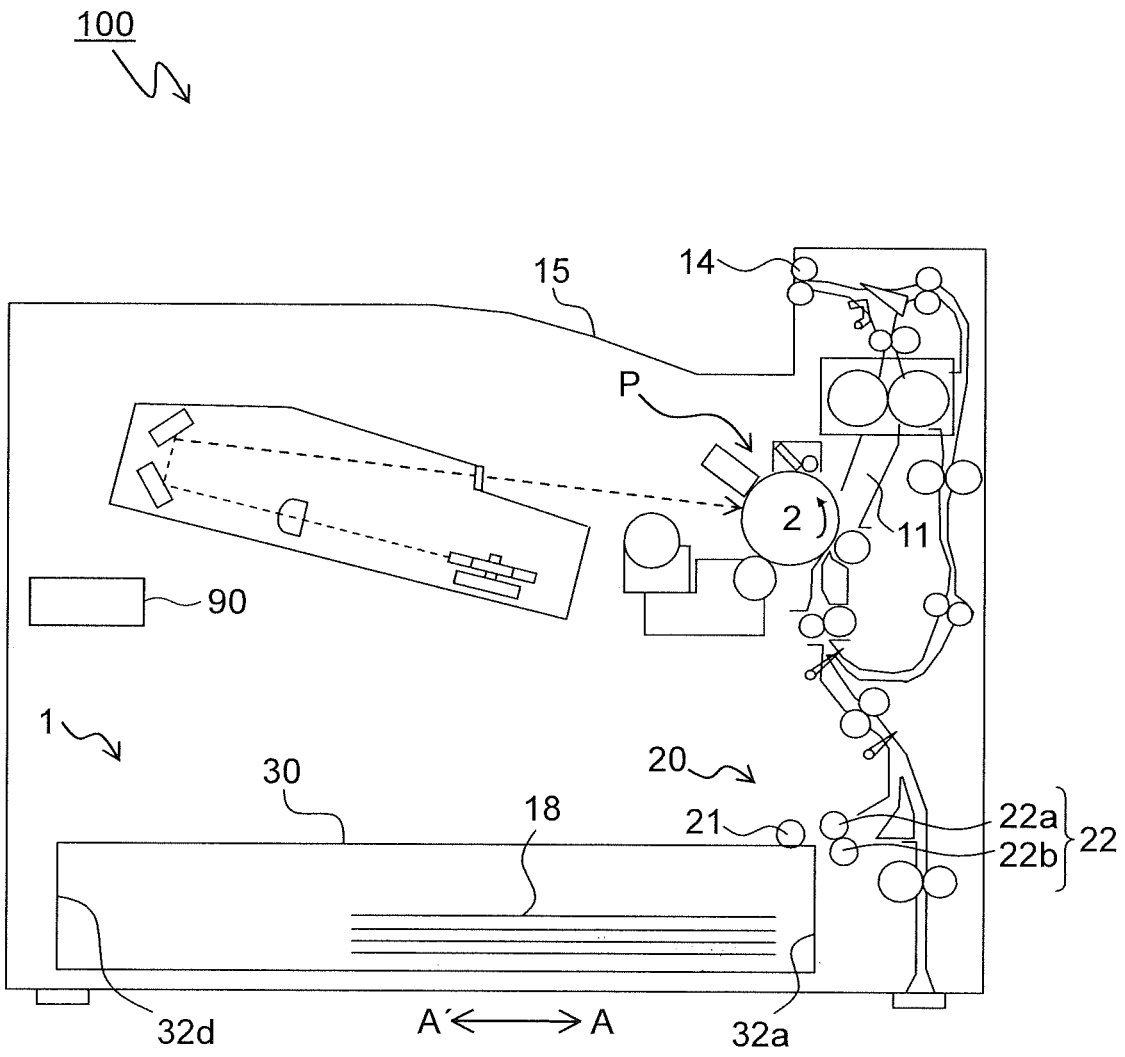
FIG. 1 is a cross-sectional view showing the structure of the image forming apparatus of an embodiment.

An image forming apparatus 100 according to the embodiment of the present disclosure will be described with reference to FIGS. 1 to 9. Here, as the image forming apparatus 100, a monochrome printer is described. Within the main body of the image forming apparatus 100, as shown in FIG. 1, an image forming portion P is arranged which forms a monochrome image with individual steps of charging, exposure, development and transfer.

In the image forming portion P, along the direction of rotation of a photosensitive drum 2 (counterclockwise direction in FIG. 1), a charging portion, an exposure unit, a development device, a transfer roller, a cleaning device and a static elimination device (unillustrated) are arranged.

Sheets 18 which are stored in a paper feed cassette (sheet storage cassette) 30 are transported through a sheet transport path 11 and a registration roller pair with predetermined timing. In the image forming portion P in which a toner image is formed, the toner image on the surface of the photosensitive drum 2 is transferred to the sheet 18 with the transfer roller. The sheet 18 to which the toner image is transferred is separated from the photosensitive drum 2, is transported to a fixing portion and is heated and pressurized, and thus the toner image is fixed to the sheet 18.

The sheet 18 which is passed through the fixing portion is switched in the direction of transport with a branch portion which is branched into a plurality of directions. Then, the sheet 18 is ejected with an ejection roller pair 14 to an ejection tray 15 without being processed (or after being fed to a double-sided transport path where double-sided printing is performed).

The paper feed cassette 30 is formed so as to be removable with respect to a cassette fitting portion 1 in the main body of the image forming apparatus 100. In the image forming apparatus 100, on the downstream side in the feed direction (the sheet feed direction, the direction of an arrow A) of the paper feed cassette 30, the sheet transport path 11 is provided which is used when the sheet is fed from below the main body of the image forming apparatus 100. Hence, the paper feed cassette 30 is pulled out in the leftward direction of FIG. 1 (the direction of an arrow A'). In other words, the leftward direction of FIG. 1 is the direction in which the paper feed cassette 30 is pulled out, and the rightward direction is the direction in which the paper feed cassette 30 is fitted.

In an opposite portion opposite part of the cassette fitting portion 1 on the downstream side in the direction of fitting of the paper feed cassette 30 (the right side of FIG. 1), a feed portion 20 which feeds out the sheet 18 is provided. The feed portion 20 includes a pickup roller 21 and a feed roller 22*a*.

The pickup roller 21 is pressed to the uppermost surface of the sheets 18 stacked in the paper feed cassette 30 and is rotated so as to feed out the sheet 18. The feed roller 22*a* transports the sheet 18 fed out from the pickup roller 21. A retard roller 22*b* is pressed to the feed roller 22*a*, and these two rollers form a transport roller pair 22.

When a plurality of sheets 18 are simultaneously fed with the pickup roller 21, the sheets 18 are separated with the transport roller pair 22. In this way, only the uppermost sheet 18 is fed out toward the sheet transport path 11.

Figure 2:
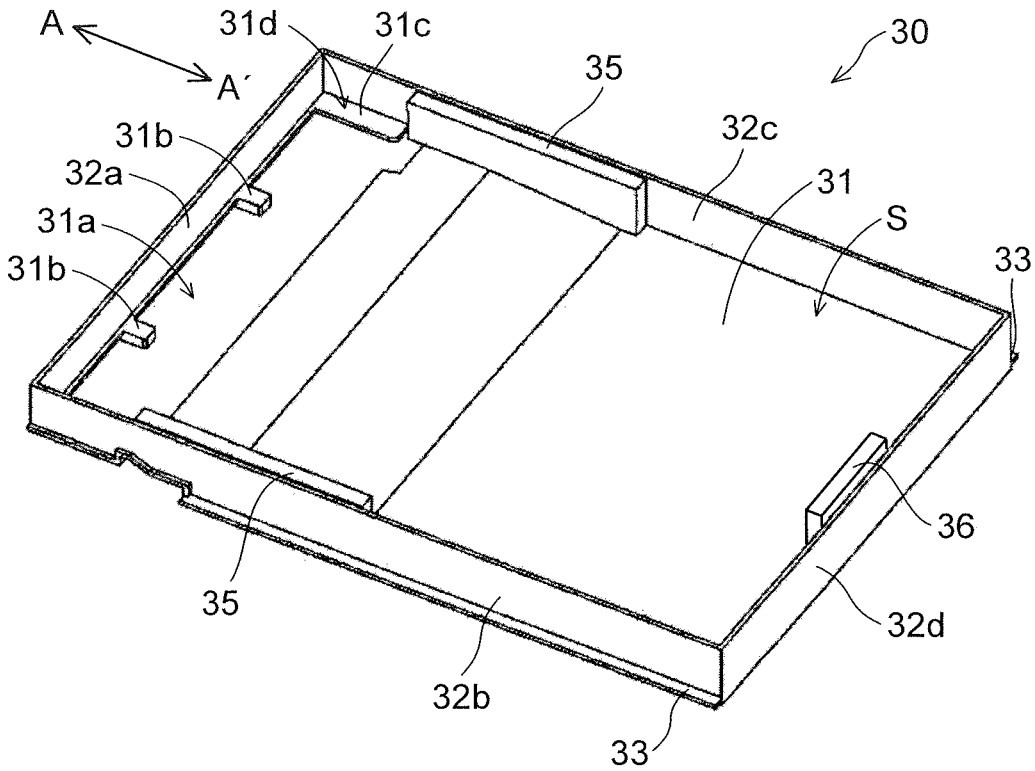
FIG. 2 is a perspective view showing the structure of a paper feed cassette in the image forming apparatus of the embodiment.

FIG. 2 is a perspective view showing the structure of the paper feed cassette 30 in the image forming apparatus 100. FIG. 2 shows a state which is seen from the back side of the plane of FIG. 1, and the direction in which the paper feed cassette 30 is fed out and the direction in which the paper feed cassette 30 is fitted are laterally opposite to FIG. 1.

In FIG. 2, in the paper feed cassette 30, on the four peripheral portions of a cassette base 31 in which the sheets 18 are stacked on its upper surface, side walls 32*a* to 32*d* are provided so as to stand. In this way, the paper feed cassette 30 is formed in the shape of a flat box with its upper surface open, and the sheets 18 are stacked from the upward direction thereof. The cassette base 31 and the side walls 32*a* to 32*d* form a sheet storage portion S in which the sheets are stored.

On the outer sides of the side walls 32*b* and 32*c* parallel to the direction in which the paper feed cassette 30 is fitted and the direction in which the paper feed cassette 30 is pulled out (the directions of arrows AA'), a pair of cassette rails 33 is additionally provided. On the side of the main body of the image forming apparatus 100, a pair of main body rails 44 (see FIG. 3) is provided which slidably guide the cassette rails 33. The cassette rails 33 are made to slide along the main body rails 44, and thus the paper feed cassette 30 can be inserted and pulled out with respect to the main body of the image forming apparatus 100.

Within the paper feed cassette 30, a pair of width regulation cursors 35 is provided so as to stand along the feed direction (the direction of the arrow A). The pair of width regulation cursors 35 can be moved toward each other in the sheet width direction orthogonal to the feed direction, and make contact with the side surfaces of a sheet stack from both sides in the sheet width direction so as to locate the sheet stack in the sheet width direction thereof.

On the upstream side in the feed direction within the paper feed cassette 30, a back end regulation cursor 36 is provided such that the back end regulation cursor 36 can be moved along the feed direction. The back end regulation cursor 36 makes contact with the back end surface of the sheet stack from the upstream side in the feed direction so as to locate the sheet stack in the feed direction.

Although in the cassette base 31, slits and the like for allowing the movements of the width regulation cursors 35 and the back end regulation cursor 36 are provided, they are omitted for the simplification of the drawings.

Here, in the present embodiment, in a position opposite a lift plate 50 of the cassette base 31 which will be described later, an opening portion 31*a* is formed through which at least part of the lift plate 50 can be passed.

In an edge portion of the opening portion 31*a* on the downstream side in the feed direction, a pair of tip end support portions (support protrusion portions) 31*b* is provided which are protruded to the upstream side in the feed direction. The tip end support portions 31*b* are arranged a predetermined distance apart in the sheet width direction so as to support tip end edge portions of the sheets 18. In edge portions of the opening portion 31*a* in the sheet width direction, a pair of corner support portions 31*c* is provided which are protruded inward in the sheet width direction so as to support the tip end corner portions of the sheets 18. As will be described in detail later, the tip end support portions 31*b* and the corner support portions 31*c* form a step portion 31*d*.

Figure 3:
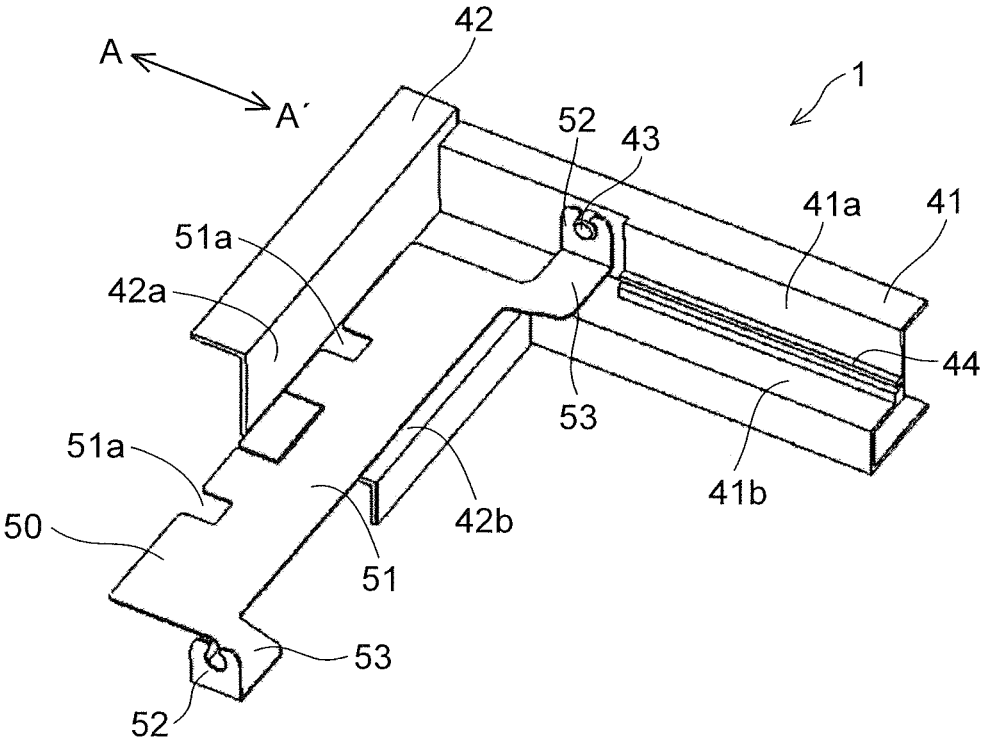
FIG. 3 is a perspective view showing the structure of part of a cassette fitting portion in the image forming apparatus of the embodiment.

In the present embodiment, as shown in FIG. 3, the lift plate 50 is provided in the cassette fitting portion 1. The lift plate 50 is arranged in a position opposite a tip end portion of the paper feed cassette 30 in the direction of the fitting, and the downstream end thereof in the feed direction swings in an up/down direction. A part of the lift plate 50 on the upstream side in the feed direction is supported by the cassette fitting portion 1 such that the lift plate 50 can be turned.

Figure 4:
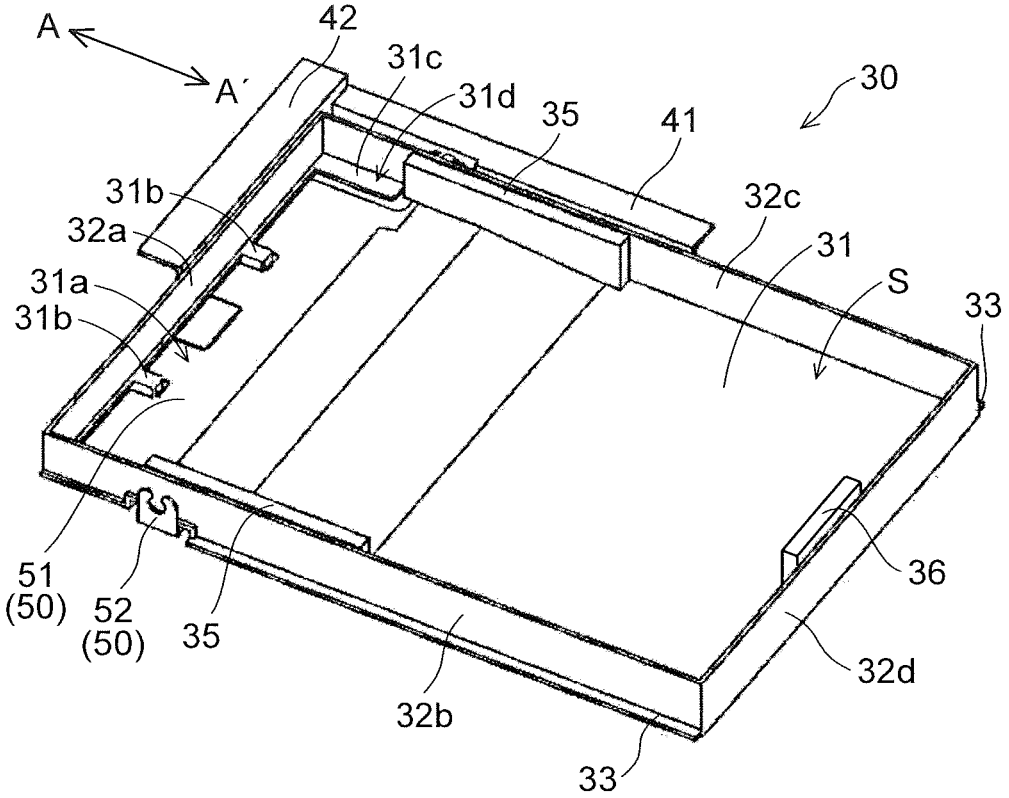
FIG. 4 is a perspective view showing the structure of part of the cassette fitting portion and the structure of the paper feed cassette in the image forming apparatus of the embodiment.

Specifically, as shown in FIGS. 3 and 4, the cassette fitting portion 1 includes main body frames 41 and 42. The pair of main body frames 41 is extended along the feed direction and are arranged opposite the side walls 32*b* and 32*c* of the paper feed cassette 30. The main body frame 42 is extended in the sheet width direction and is arranged opposite the side wall 32*a* of the paper feed cassette 30.

For the simplification of the drawings, only one of the main body frames 41 is drawn. Although the main body frame 41 is formed so as to be extended from the downstream end to the upstream end of the paper feed cassette 30, the part on the upstream side is omitted. Although the main body frame 42 is formed so as to connect the pair of main body frames 41, part thereof is omitted.

The main body frame 41 includes a side surface portion 41*a* (a main body side surface) and a bottom surface portion 41*b* which is protruded from lower end a portion of the side surface portion 41*a* inward in the sheet width direction. In a predetermined position of the side surface portion 41*a*, a shaft portion 43 is fixed which serves as the center of the turning of the lift plate 50. In a connection portion of the side surface portion 41*a* and the bottom surface portion 41*b*, the main body rail 44 described above is provided.

The main body frame 42 includes a side surface portion 42*a* and a bottom surface portion 42*b* which is protruded from a lower end portion of the side surface portion 42*a* to the upstream side in the feed direction. The side surface portion 42*a* makes contact with the side wall 32*a* of the paper feed cassette 30 so as to locate the paper feed cassette 30. The bottom surface portion 42*b* supports the push-up plate 62 of a lift mechanism 60 which will be described later.

The lift plate 50 is formed of sheet metal, and includes a sheet support portion 51, a pair of arm portions 52 and a pair of joint portions 53. The sheet support portion 51 supports the sheets 18. The pair of arm portions 52 is provided so as to stand on both end portions of the sheet support portion 51 in the sheet width direction, and is supported to the shaft portions 43 of the cassette fitting portion 1 such that the pair of arm portions 52 can be turned. The pair of joint portions 53 connects both the end portions of the sheet support portion 51 in the sheet width direction and the pair of arm portions 52.

The sheet support portion 51 is formed so as to be smaller than the opening portion 31*a* of the cassette base 31. The joint portions 53 are formed so as to be extended to the outer sides of the side walls 32*b* and 32*c* of the paper feed cassette 30 in the sheet width direction. The arm portions 52 are arranged on the outer sides of the paper feed cassette 30 in the sheet width direction. The lift plate 50 is turned about the shaft portions 43 with the downstream end thereof in the feed direction serving as a turning end.

In an edge portion of the sheet support portion 51 on the downstream side in the feed direction, slits 51*a* (see FIG. 3) through which the tip end support portions 31*b* can be passed are provided in parts opposite the tip end support portions 31*b* of the paper feed cassette 30. Between the sheet support portion 51 and the side surface portion 42*a*, a gap is provided which is larger than the thickness of the side wall 32*a* of the paper feed cassette 30. The slits 51*a* are formed so as to be slightly larger than the tip end support portions 31*b*.

Figure 5:
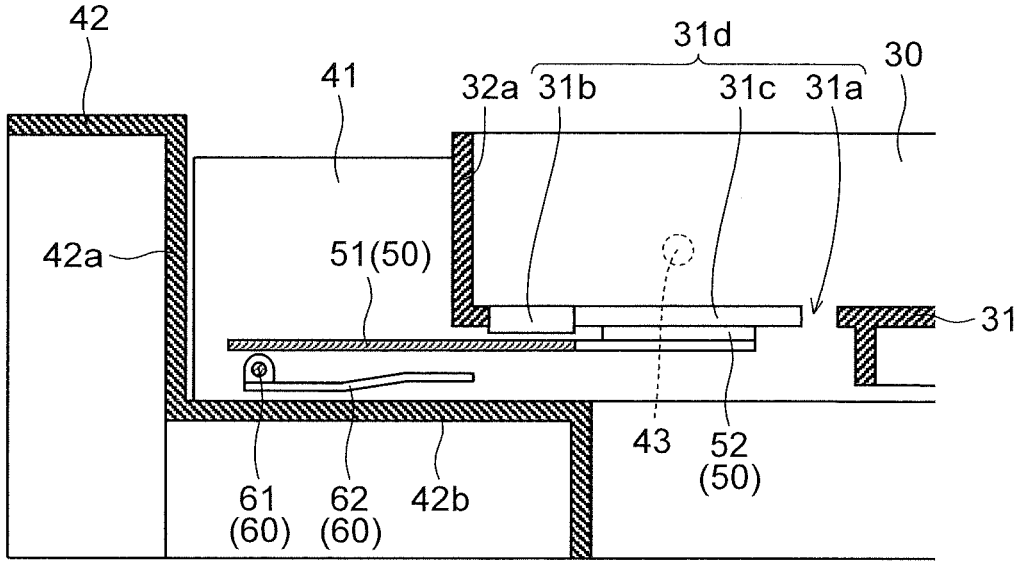
FIG. 5 is a cross-sectional view showing, along a center in the sheet width direction, a state where the paper feed cassette is in the middle of being fitted or removed with respect to the cassette fitting portion in the image forming apparatus of the embodiment, and is a diagram showing a state where a lift plate is arranged in a lowered position.

As shown in FIG. 5, in a downstream portion of the cassette base 31 in the feed direction, the step portion 31*d* is provided in which a bottom portion is shifted upward as compared with the other portion of the cassette base 31. The opening portion 31*a* is formed in the step portion 31*d*.

In the cassette fitting portion 1, the lift mechanism 60 is arranged which raises and lowers the downstream end of the lift plate 50 in the feed direction. The lift mechanism 60 is arranged in a space S31 (see FIG. 7) which is defined by the step portion 31*d* and the bottom surface portion 42*b* in a state where the paper feed cassette 30 is fitted to the cassette fitting portion 1.

Figure 6:
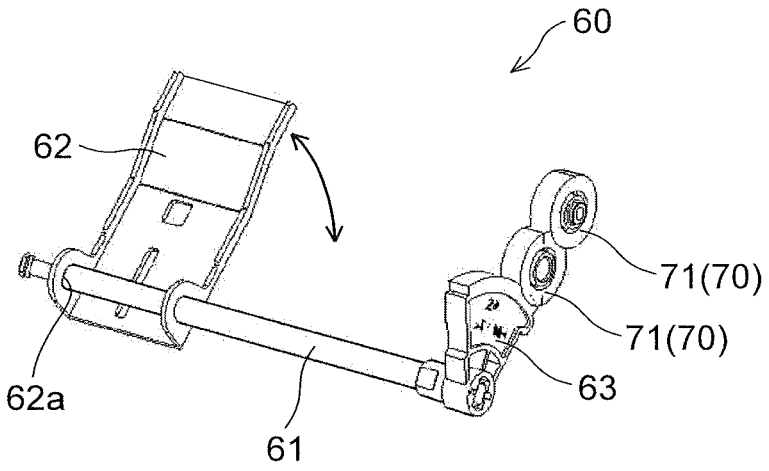
FIG. 6 is a perspective view showing the structure of a lift mechanism in the image forming apparatus of the embodiment.

As shown in FIG. 6, the lift mechanism 60 is formed with a turning shaft portion 61, the push-up plate 62 and a sector gear (push-up gear) 63. For the simplification of the drawings, in the figures other than FIGS. 5 to 7, the lift mechanism 60 is omitted.

Figure 7:
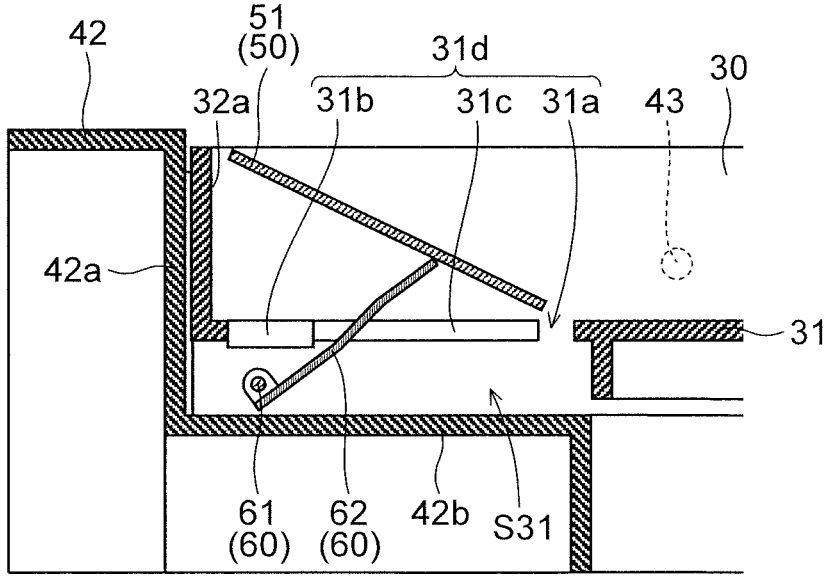
FIG. 7 is a cross-sectional view showing, along the center in the sheet width direction, a state where the paper feed cassette is fitted to the cassette fitting portion in the image forming apparatus of the embodiment, and is a diagram showing a state where the lift plate is arranged in a raised position.

The turning shaft portion 61 penetrates a fixing hole 62*a* of the push-up plate 62 on one end, and thus the push-up plate 62 is fixed to the turning shaft portion 61. The push-up plate 62 is arranged in a position opposite a substantially center portion of the back surface of the lift plate 50 in the sheet width direction. As shown in FIG. 7, the push-up plate 62 lifts up the lift plate 50 from below so as to turn the lift plate 50. The turning shaft portion 61 is supported to the main body frames 41 such that the turning shaft portion 61 can be turned.

As shown in FIG. 6, the sector gear 63 is coupled to the other end of the turning shaft portion 61 and is turned together with the push-up plate 62. The sector gear 63 is coupled to a drive mechanism 70 which is formed with a plurality of gears 71 and a drive motor (drive source). The drive motor (unillustrated) is rotated forward and backward, and thus the sector gear 63 and the push-up plate 62 are turned in forward and backward directions, with the result that the lift plate 50 is raised and lowered. The drive mechanism 70 is provided in the main body of the image forming apparatus 100 (here, the cassette fitting portion 1), and is controlled by a control portion 90 (see FIG. 1) which controls the entire image forming apparatus 100.

Figure 8:
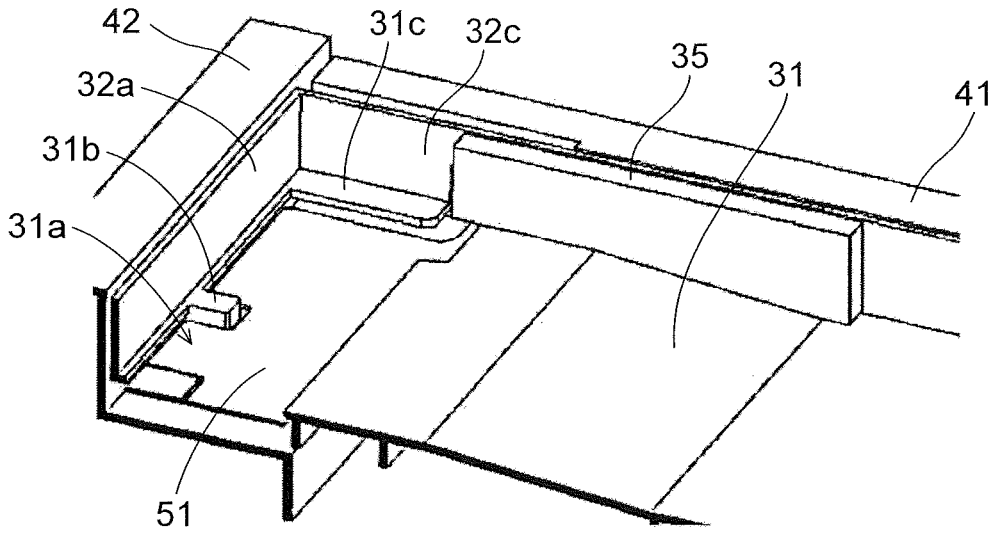
FIG. 8 is a cross-sectional perspective view showing the state where the paper feed cassette is fitted to the cassette fitting portion in the image forming apparatus of the embodiment, and is a diagram showing the state where the lift plate is arranged in the lowered position.

When the paper feed cassette 30 is fitted or removed or when a non-image formation operation is performed, the sector gear 63 of the lift mechanism 60 is rotated in the backward direction by the drive mechanism 70. In this way, the push-up plate 62 is held in a state (the state of FIG. 5) where the push-up plate 62 falls. Here, as shown in FIGS. 5 and 8, the lift plate 50 is held in a horizontal state and is arranged in a lowered position in which the lift plate 50 is located below the cassette base 31.

Figure 9:
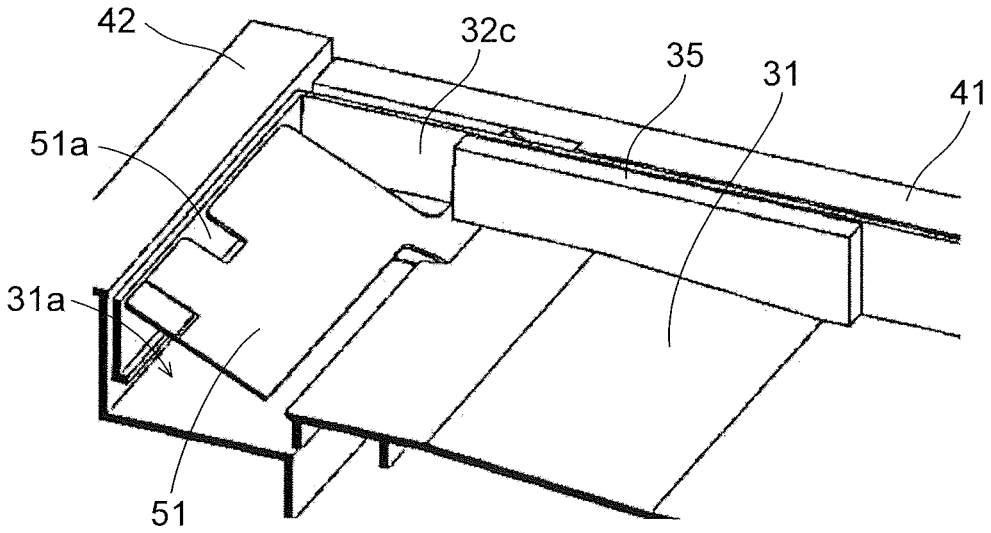
FIG. 9 is a cross-sectional perspective view showing the state where the paper feed cassette is fitted to the cassette fitting portion in the image forming apparatus of the embodiment, and is a diagram showing the state where the lift plate is arranged in the raised position.

On the other hand, when an image formation operation is performed, the sector gear 63 of the lift mechanism 60 is rotated in the forward direction by the drive mechanism 70. In this way, the push-up plate 62 is held in a state (the state of FIG. 7) where the push-up plate 62 rises. Here, as shown in FIGS. 7 and 9, the lift plate 50 is turned such that the downstream end (turning end) in the feed direction is raised. Then, the lift plate 50 is arranged in a raised position in which the lift plate 50 is protruded above the cassette base 31 through the opening portion 31*a* of the cassette base 31 in the paper feed cassette 30. The lift plate 50 is arranged in the raised position, and thus the sheet stack on the lift plate 50 is pressed to the pickup roller 21, with the result that a state where paper feed is allowed is entered.

In the present embodiment, as described above, the lift plate 50 for raising and lowering the sheets 18 is provided in the cassette fitting portion 1. In this way, as compared with a case where the lift plate 50 is provided in the paper feed cassette 30, the accuracy of the position of the lift plate 50 can easily be enhanced.

Specifically, in the case where the lift plate 50 is provided in the paper feed cassette 30, both a displacement error in the lift plate 50 with respect to the sheet storage portion S of the paper feed cassette 30 and a displacement error in the sheet storage portion S with respect to the main body of the image forming apparatus 100 are produced. On the other hand, in the present embodiment, the lift plate 50 is provided in the cassette fitting portion 1 of the main body of the image forming apparatus 100, and thus only a displacement error in the lift plate 50 with respect to the main body of the image forming apparatus 100 is produced. Hence, the accuracy of the position of the lift plate 50 can easily be enhanced.

The lift plate 50 is provided in the cassette fitting portion 1, and thus unlike the case where the lift plate 50 is provided in the paper feed cassette 30, the lift plate 50 is not supported by the paper feed cassette 30. Hence, it is not necessary to enhance the rigidity of the paper feed cassette 30. Thus, it is possible to reduce the weight of the paper feed cassette 30, and consequently, the operability of the paper feed cassette 30 by a user can be enhanced.

As compared with the case where the lift plate 50 is provided in the paper feed cassette 30, the structure of the paper feed cassette 30 can be simplified. Hence, the weight of the paper feed cassette 30 can be more reduced, and thus the operability of the paper feed cassette 30 by the user can be more enhanced.

The lift mechanism 60 is provided in the cassette fitting portion 1, and thus unlike a case where the lift mechanism 60 is provided in the paper feed cassette 30, it is not necessary to provide members such as a gear for transmitting a drive force from the side of the main body of the image forming apparatus 100 to the side of the paper feed cassette 30. Hence, it is possible to reduce the cost of the image forming apparatus 100.

As described previously, in the edge portion of the opening portion 31*a* on the downstream side in the feed direction, the tip end support portions 31*b* are provided which are protruded to the upstream side in the feed direction so as to support the edge portions of the sheets 18. In this way, the drop of the sheets 18 from the opening portion 31*a* can easily be reduced. In the edge portion of the lift plate 50 on the downstream side in the feed direction, the slits 51*a* through which the tip end support portions 31*b* can be passed are formed in the parts opposite the tip end support portions 31*b*. In this way, while the lift plate 50 is being prevented from colliding with the tip end support portions 31*b*, the tip ends of the sheets 18 can be supported by the lift plate 50.

As described previously, the joint portions 53 of the lift plate 50 are formed so as to be extended to the outer sides of the side walls 32*b* and 32*c* of the paper feed cassette 30 in the sheet width direction. The arm portions 52 are arranged on the outer sides of the paper feed cassette 30 in the sheet width direction. In this way, while the lift plate 50 is being supported by the main body of the image forming apparatus 100 such that the lift plate 50 can be turned, the lift plate 50 can easily be arranged in the lowered position and in the raised position.

It should be considered that the embodiment disclosed herein is illustrative in all respects and not restrictive. The scope of the present disclosure is indicated not by the description of the embodiment discussed above but by the scope of claims, and furthermore, meanings equivalent to the scope of claims and all modifications within the scope are included.

For example, although the example where the present disclosure is applied to the monochrome printer is described, the present disclosure is not limited to this example. Needless to say, the present disclosure can be applied to various image forming apparatuses, such as a color printer, a monochrome copying machine, a color copying machine, a digital copying machine and a facsimile machine, which include a sheet storage cassette.

Although in the embodiment discussed above, the example where the push-up plate 62 is used to raise and lower the lift plate 50 is described, the lift plate 50 may be raised and lowered without use of the push-up plate 62. For example, the shaft portion 43 is formed such that the shaft portion 43 can be rotated with respect to the side surface portion 41*a* of the main body frame 41, the lift plate 50 is fixed to the shaft portion 43 and an input gear (unillustrated) is fixed to the end portion of the shaft portion 43. Then, the gears 71 of the drive mechanism 70 may be connected to the input gear. In this case, the lift mechanism is formed with the shaft portion 43 and the input gear.

For example, a compression spring (unillustrated) which biases the back surface of the lift plate 50 upward and a pressing member which is formed with an eccentric cam capable of pressing the lift plate 50 downward and the like may be used so as to raise and lower the lift plate 50. In this case, the compression spring, the pressing member and the like form the lift mechanism.

What is claimed is:

1. An image forming apparatus comprising:

a cassette fitting portion which is provided in a main body of the apparatus and which includes a feed portion that feeds a sheet; and a sheet storage cassette which can be fitted to the cassette fitting portion along a sheet feed direction and which includes a sheet storage portion that stores the sheet;

wherein the cassette fitting portion includes a lift plate which is arranged below an end portion of the sheet storage cassette fitted to the cassette fitting portion on a downstream side in the sheet feed direction and which lifts the sheet stored in the sheet storage portion, the sheet storage portion includes a cassette base in which the sheet is stacked on an upper surface and a side wall which is provided so as to stand from end portions of the cassette base on the downstream side, the cassette base is provided with an opening portion in a position opposite the lift plate, in a state where the sheet storage cassette is fitted to the cassette fitting portion, the lift plate is arranged selectively either in a lowered position or a raised position, the lowered position in which the lift plate is arranged below the cassette base and in which the sheet storage cassette is removable with respect to the cassette fitting portion, the raised position in which the lift plate is protruded above the cassette base through the opening portion so as to allow the sheet to be fed with the feed portion, the cassette base is provided with a support protrusion portion in an edge portion of the opening portion on the downstream side, the support protrusion portion protrudes to an upstream side in the sheet feed direction so as to support a tip end portion of the sheet, and the lift plate is provided with a slit in an edge portion thereof on the downstream side, the slit is arranged in part opposite the support protrusion portion so as to allow the support protrusion portion to pass through.

2. The image forming apparatus according to claim 1, wherein the lift plate includes a sheet support portion which supports the sheet and a pair of arm portions which is provided so as to stand on both end portions of the sheet support portion in a sheet width direction orthogonal to the sheet feed direction and which are supported to the cassette fitting portion such that the pair of arm portions can be turned, and the pair of arm portions is arranged on outer sides of the sheet storage cassette in the sheet width direction.

3. The image forming apparatus according to claim 2, wherein the lift plate further includes a pair of joint portions which connect both the end portions of the sheet support portion in the sheet width direction and the pair of arm portions, and the joint portions are formed so as to be extended to outer sides of the side wall of the sheet storage cassette in the sheet width direction.

4. The image forming apparatus according to claim 2, wherein the cassette fitting portion further includes a pair of main body side surfaces which is extended along the sheet feed direction and a pair of main body rails which is formed along the pair of main body side surfaces, the sheet storage cassette includes a pair of cassette rails which is slidably guided to the pair of main body rails, in the pair of main body side surfaces, a pair of shaft portions is individually provided adjacent to end portions of the pair of cassette rails on the downstream side and the pair of arm portions is individually supported to the pair of shaft portions such that the pair of arm portions can be turned.

5. The image forming apparatus according to claim 1, wherein the cassette fitting portion further includes a side surface portion opposite the side wall of the sheet storage cassette and a bottom surface portion which is protruded from the side surface portion to the upstream side in the sheet feed direction, the cassette base includes a step portion which is located on the downstream side thereof, the step portion is provided such that a bottom portion of the cassette base is shifted upward, the opening portion is formed in the step portion and in the state where the sheet storage cassette is fitted to the cassette fitting portion, the step portion is arranged above the bottom surface portion.

6. The image forming apparatus according to claim 5 comprising:

a lift mechanism which raises and lowers a downstream end of the lift plate in the sheet feed direction, wherein the lift mechanism is arranged in a space between the step portion and the bottom surface portion.

7. The image forming apparatus according to claim 1, wherein the cassette fitting portion further includes a pair of main body side surfaces which is extended along the sheet feed direction and a pair of main body rails which is formed along the pair of main body side surfaces, and the sheet storage cassette includes a pair of cassette rails which is slidably guided to the pair of main body rails.

8. An image forming apparatus comprising:

a cassette fitting portion which is provided in a main body of the apparatus and which includes a feed portion that feeds a sheet; and a sheet storage cassette which can be fitted to the cassette fitting portion along a sheet feed direction and which includes a sheet storage portion that stores the sheet;

wherein the cassette fitting portion includes a lift plate which is arranged below an end portion of the sheet storage cassette fitted to the cassette fitting portion on a downstream side in the sheet feed direction and which lifts the sheet stored in the sheet storage portion, the sheet storage portion includes a cassette base in which the sheet is stacked on an upper surface and a side wall which is provided so as to stand from end portions of the cassette base on the downstream side, the cassette base is provided with an opening portion in a position opposite the lift plate, in a state where the sheet storage cassette is fitted to the cassette fitting portion, the lift plate is arranged selectively either in a lowered position or a raised position, the lowered position in which the lift plate is arranged below the cassette base and in which the sheet storage cassette is removable with respect to the cassette fitting portion, the raised position in which the lift plate is protruded above the cassette base through the opening portion so as to allow the sheet to be fed with the feed portion, the cassette fitting portion further includes a side surface portion opposite the side wall of the sheet storage cassette and a bottom surface portion which is protruded from the side surface portion to the upstream side in the sheet feed direction, the cassette base includes a step portion which is located on the downstream side thereof, the step portion is provided such that a bottom portion of the cassette base is shifted upward, the opening portion is formed in the step portion, in the state where the sheet storage cassette is fitted to the cassette fitting portion, the step portion is arranged above the bottom surface portion, the image forming apparatus further comprises a lift mechanism which raises and lowers a downstream end of the lift plate in the sheet feed direction, and the lift mechanism is arranged in a space between the step portion and the bottom surface portion.

* * * * *